US006474861B1

(12) United States Patent
De Laforcade

(10) Patent No.: US 6,474,861 B1
(45) Date of Patent: Nov. 5, 2002

(54) DEVICE FOR MIXING AT LEAST TWO PRODUCTS

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/551,155

(22) Filed: Apr. 14, 2000

(30) Foreign Application Priority Data

Apr. 16, 1999 (FR) ..... 99 04817

(51) Int. Cl.[7] ..... B01F 1/00
(52) U.S. Cl. ..... 366/130; 206/219; 215/DIG. 8
(58) Field of Search ..... 366/130; 206/219, 206/221; 215/DIG. 8

(56) References Cited

U.S. PATENT DOCUMENTS

| | | | | |
|---|---|---|---|---|
| 3,410,444 A | | 11/1968 | Morane | |
| 5,647,481 A | * | 7/1997 | Hundertmark et al. | 206/219 |
| 5,692,644 A | | 12/1997 | Gueret | |
| 6,068,396 A | * | 5/2000 | Baudin | 366/130 |

FOREIGN PATENT DOCUMENTS

| | | |
|---|---|---|
| FR | 1 542 467 | 10/1968 |
| FR | 2 129 079 | 10/1972 |
| FR | 2 239 390 | 2/1975 |
| FR | 2 722 765 | 1/1996 |
| GB | 1 376 951 | 12/1974 |
| GB | 1 436 648 | 5/1976 |

* cited by examiner

*Primary Examiner*—Matthew O. Savage
(74) *Attorney, Agent, or Firm*—Finnegan, Henderson, Farabow, Garrett & Dunner, L.L.P.

(57) ABSTRACT

This application relates to a mixing device for mixing at least two products. The device includes a first container containing a first product, preferably a liquid, and a second container containing a second product, preferably a powder, the first and second containers being separated in sealed fashion by a removable stopper. The mixing device comprises a flexible finger coupled to an operating member and capable, in response to actuation of the operating member, of engaging the stopper. While engaging the stopper, the flexible finger may flex elastically into a position of abutment against a stop borne by the stopper. In this position the flexible finger forms a buttress-like prop capable of releasing the stopper so as to allow the first and second products to be mixed.

72 Claims, 4 Drawing Sheets

DEVICE FOR MIXING AT LEAST TWO PRODUCTS

Figure 1:
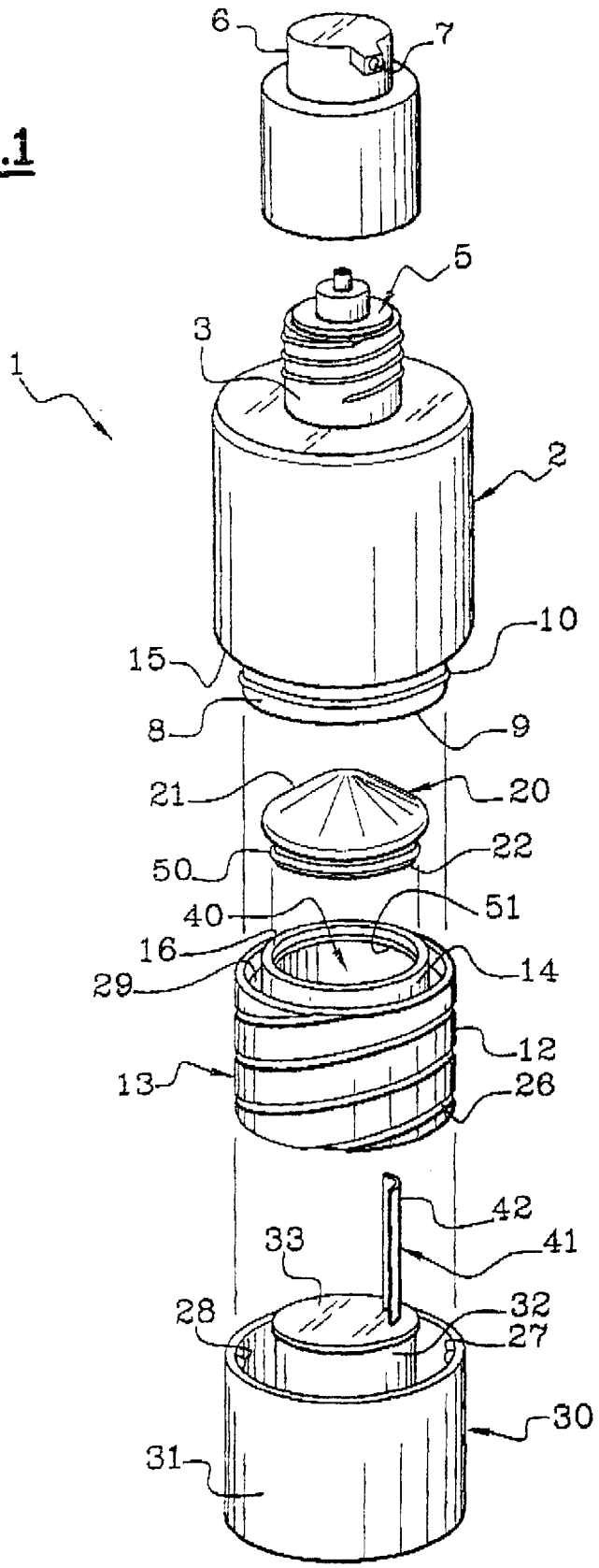

The present invention relates to a device for mixing at least two products which, usually for reasons of stability, cannot be mixed until the time of use. By way of example, mention may be made of certain hair coloration products, obtained from a mixture of a colorant and an oxidizing agent.

By way of further example, mention may be made of mixtures of which one component is vitamin C, for example, in the form of a powder.

There is known, particularly from FR-A-2,129,079, a mixer consisting of a first reservoir equipped with a dispensing orifice, a second cylindrical reservoir having one of its ends contiguous with the first reservoir and closed at both ends by removable walls which can be pierced by a chamfered tube which can move between (i) a position in which it lies outside the two reservoirs and (ii) a position in which it passes longitudinally through the second reservoir and opens into the first reservoir, thus placing the two reservoirs in communication. A container of this type may separately contain, in the first reservoir, a first product such as a liquid and, in the second reservoir, a second product such as a powder.

There is also known from FR-A-2,722,765, a mixer which allows at least two products to be stored and to be mixed, and allows the mixture thus obtained to be dispensed. The mixer described in this document is of the same type as the one described in FR-A-2,129,079. However, the moving part intended to place the two reservoirs in communication includes a transverse wall which constitutes the bottom wall of the second reservoir and is located, when the moving part is in a first position, from the mouth of the second reservoir, by a distance which is roughly equal to or is greater than the travel of the moving part.

Thus, as the moving part is moved into a second position, the volume of the second reservoir is reduced until it becomes zero, so that the two products contained in the respective reservoirs mix suitably, regardless of the orientation of the container. The transverse wall of the moving part is flat and surrounded by a chamfered edge, the upper end of which lies in a plane which is inclined with respect to a plane perpendicular to the direction of travel of the moving part.

None of these devices is without its drawbacks, particularly as far as the packaging of a sensitive powder, particularly one sensitive to oxygen, is concerned. This is because, in the case of these oxygen-sensitive products, it is necessary to reduce the volume of air formed above the volume of powder. With a design like the one described hereinabove, removing the separation between the two reservoirs is not achieved quickly, and this can cause an appreciable compacting of the powder before the separation means can be removed. Lumps of powder, the solubility of which is not as good as that of a loose powder, are thus formed. As a result, the quality of the mixture may prove insufficient.

Furthermore, if the axial height of the skirt forming the chamfered edge is increased so as to reduce the time needed to remove the separation between the two volumes, the volume available for the powder is reduced correspondingly.

Other mixing devices exhibiting drawbacks of the same type as those discussed hereinabove are described in FR-1, 542,467, and in FR-A-2,239,390.

Hence, one of the objects of the invention is to provide a device for mixing at least two products, one of which may be a powder, and which has a separating structure which, on the one hand, in the storage position, provides good separation of the products in their respective reservoirs and, on the other hand, can be released quickly.

Another object of the invention is to provide a device suited to the mixing of two products of which one is, in particular, in pulverized form, and in which the volume available for the powder is improved by comparison with the conventional devices.

A further object of the invention is to provide a mixing device suited for mixing two products, of which one, for example, is in pulverized form, and which appreciably reduces the risk of the powder becoming compacted while the separating structure between the two reservoirs is being removed.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a mixing device.

According to the invention, a device for mixing at least two products includes a first container containing a first product, and a second container containing a second product, the first and second containers being separated in sealed fashion by a removable stopper, the mixing device further comprising a flexible finger coupled to an operating member and capable, in response to actuation of the operating member, of engaging the stopper and flexing elastically into a position of abutment against a stop borne by the stopper, the flexible finger in this abutment position forming a buttress-like prop capable of moving the stopper so as to allow the first and second products to be mixed.

Since the finger is flexible, it allows it to occupy a small volume by comparison with the volume it would occupy if it were rigid. The volume available for the powder is therefore greater. Mounting the finger in such a way as to cause it to form a buttress-like prop when mixing is to be performed allows the stopper to be released even if the stopper is held very firmly, and allows this to be performed very quickly thus avoiding, when the second product is a powder, compacting the powder before the stopper has been released.

Advantageously, the flexible finger is brought into engagement with the stopper in a region located between a peripheral edge of the stopper for catching on the device, and an annular rim forming the stop on the stopper, the annular rim being concentric with the peripheral edge. A configuration of this kind is particularly advantageous in that it further reduces the time needed to release the stopper member. Such release is also possible regardless of the angular position of the flexible finger with respect to the stopper.

As a preference, the flexible finger is brought into engagement with the stopper via a rotary movement having an axial component, preferably a helical movement, in the direction of the stopper.

Advantageously, the stopper has a concave, particularly a conical, profile, capable of encouraging the finger to flex towards the stop, this further contributing to facilitating the expulsion of the stopper.

According to a preferred embodiment, the mixing device according to the present invention comprises a first container containing the first product and including a first opening intended to be placed in communication with a dispensing orifice, and a second opening, an intermediate element mounted fixedly on the second opening of the first container, the intermediate element having a first skirt, on a free edge of which the stopper is mounted, the first skirt partially defining the second container, and an operating member, one wall of which forms a moving bottom wall for the second container, the wall bearing the flexible finger, a free end of which is configured to be brought into engagement with the stopper, the operating member including at least one coupling element engaging at least one ramp, particularly a helical ramp, formed by the intermediate element so that, in response to a rotation of the operating member with respect to the intermediate element, the flexible finger can be carried along towards the stopper to cause its release, and the axial movement of the moving bottom wall inside the skirt so that the mixture produced is contained more or less inside the first container.

As a preference, the stopper is force-fitted inside the free edge of the first skirt. A fit of this type ensures that the stopper is held firmly enough on the skirt which defines the second container, even in the presence of a raised pressure associated, in particular, with a rise in temperature inside the mixing device.

The at least one ramp formed by the intermediate element may be formed by a second skirt, concentric with the first and with an inside diameter that is greater than the outside diameter of the first skirt. The first and second skirts advantageously define an annular groove, preferably a U-shaped groove, capable of receiving the free edge of the container defining the second opening, and of allowing the intermediate element to catch on the first container. The intermediate element may be caught on the upper container, particularly by snap-fastening. As a preference, in the position in which the intermediate element is mounted on the first container, that end of the skirt which bears the stopper is engaged inside the neck delimiting the second opening.

As a preference, the flexible finger consists of a skirt portion located near a peripheral edge of the wall that forms the moving bottom wall. Such a skirt portion has a thickness which, preferably, may be of the order of one millimeter, giving it preferred flexibility properties. The flexible finger preferably extends over an axial height roughly equal to the axial height of the first skirt. This feature makes it possible for the stopper to be released very quickly, that is to say, enabling only a very small angular rotation of the operating member with respect to the intermediate element, thus not appreciably reducing the volume available for the powder.

As a preference, the stopper is released after the operating member has been rotated less than 360° with respect to the intermediate element, and preferably has been rotated from 90° to 180°.

Preferably too, the skirt portion extends over an angular sector of from 20° to 90°, preferably from 45° to 70°.

According to an advantageous embodiment, a pump is mounted in the first opening so as to allow the mixture to be dispensed through the dispensing orifice. The pump may be screwed onto a neck of the first container delimiting the first opening. A dip tube may be connected to the pump and dip down practically to the bottom of the first container, means being provided to prevent the dipped tube from interfering with the release of the stopper. Alternatively, the mixture may be dispensed without using a dip tube, with the mixing device in a head-down position.

The various parts of the device may each be obtained by molding from a thermoplastic, such as a polyethylene or polypropylene. However, one of the containers, especially the upper container, may be made of glass, depending on the product that is to be packaged therein.

The mixing device according to the present invention is particularly suited to producing a mixture, particularly a mixture having a cosmetic action, the first product preferably being a liquid, the second product preferably being a powder, particularly vitamin C.

According to one aspect of the present invention, a mixing device for mixing two different products is provided. The mixing device includes a first container for containing a first product, a second container for containing a second product, a removable stopper configured to seal the first container from the second container, and an operating member having a flexible finger configured to engage and move the removable stopper from a sealing position upon actuation of the operating member so as to permit mixing of first and second products.

According to another aspect of the invention, a method of mixing a first product and a second product is provided. The method includes providing a mixing device comprising a first container for containing a first product, a second container for containing a second product, a removable stopper configured to seal the first container from the second container, and an operating member having a flexible finger configured to engage and move the removable stopper from a sealing position upon actuation of the operating member so as to permit mixing of first and second products, the mixing device containing a liquid product in the first container and a powdered product in the second container, rotating the operating member, removing the removable stopper from a sealed position between the first and second containers, and mixing the liquid product and the powdered product to produce a final product.

According to yet another aspect of the invention, a mixing device for mixing at least two different products is provided. The mixing device comprises an upper container for containing a first product, a lower container for containing a second product, a releasable sealing element between the upper container and the lower container, and a flexible finger within the lower container, the flexible finger configured to engage and release the sealing element from a sealing position between the containers so as to permit mixing of first and second products.

According to a further aspect of the present invention, a method of mixing a first product and a second product is provided. The method includes providing a mixing device comprising an upper container for containing a first product, a lower container for containing a second product, a releasable sealing element between the upper container and the lower container, and a flexible finger within the lower container, the flexible finger configured to engage and release the sealing element from a sealing position between the containers so as to permit mixing of first and second products, the mixing device containing a liquid product in the upper container and a powdered product in the lower container, axially moving the flexible finger toward the releasable sealing element, releasing the sealing element from a sealing position between the upper and lower containers, and mixing the liquid product and the powdered product to produce a final product.

Beside the structural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an exploded view of one embodiment of the mixing device according to the present invention; and FIGS. 2A–2C are cross-sectional side view of various stages in producing a mixture using the mixing device depicted in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
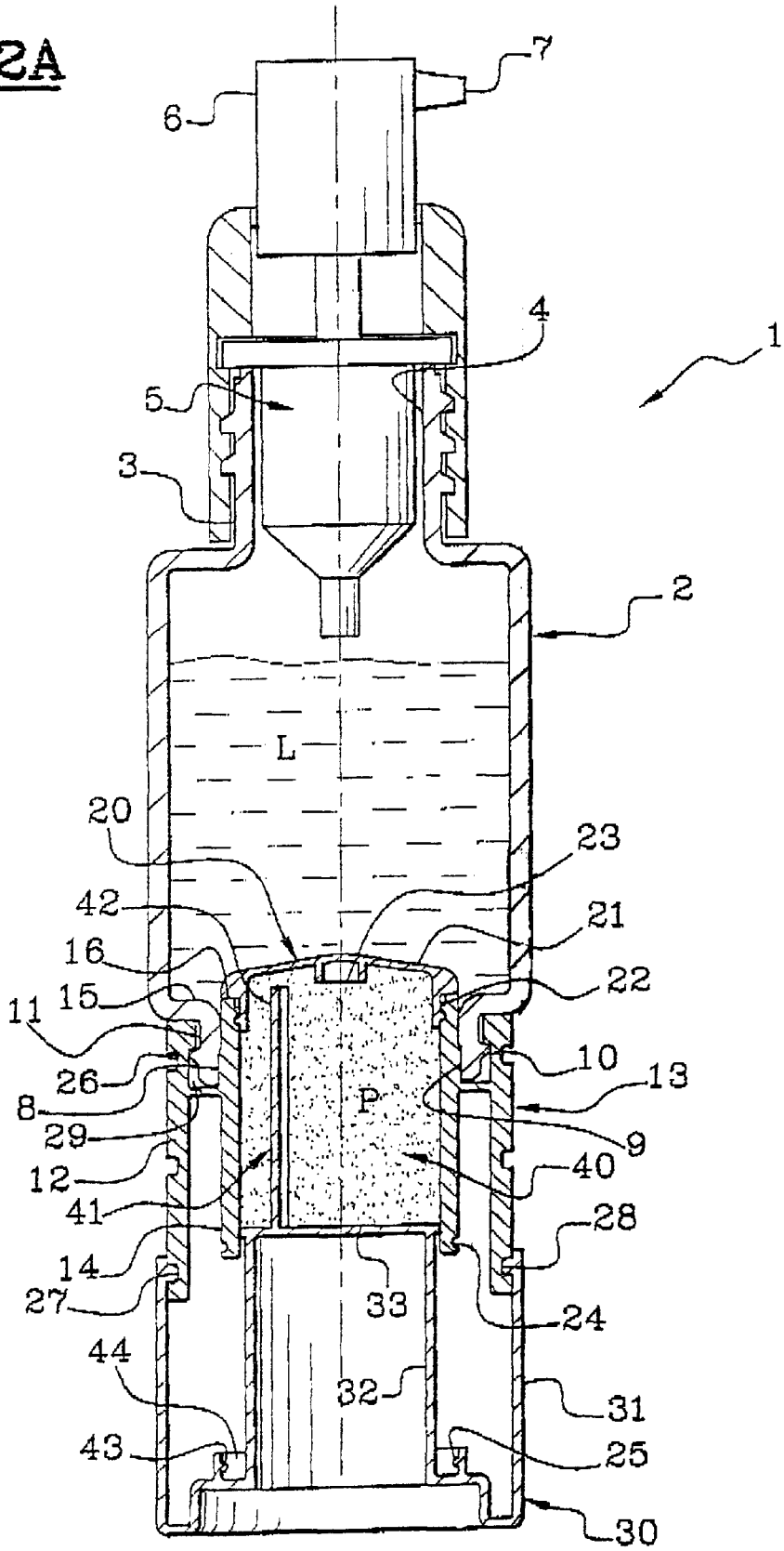
Figure 2B:
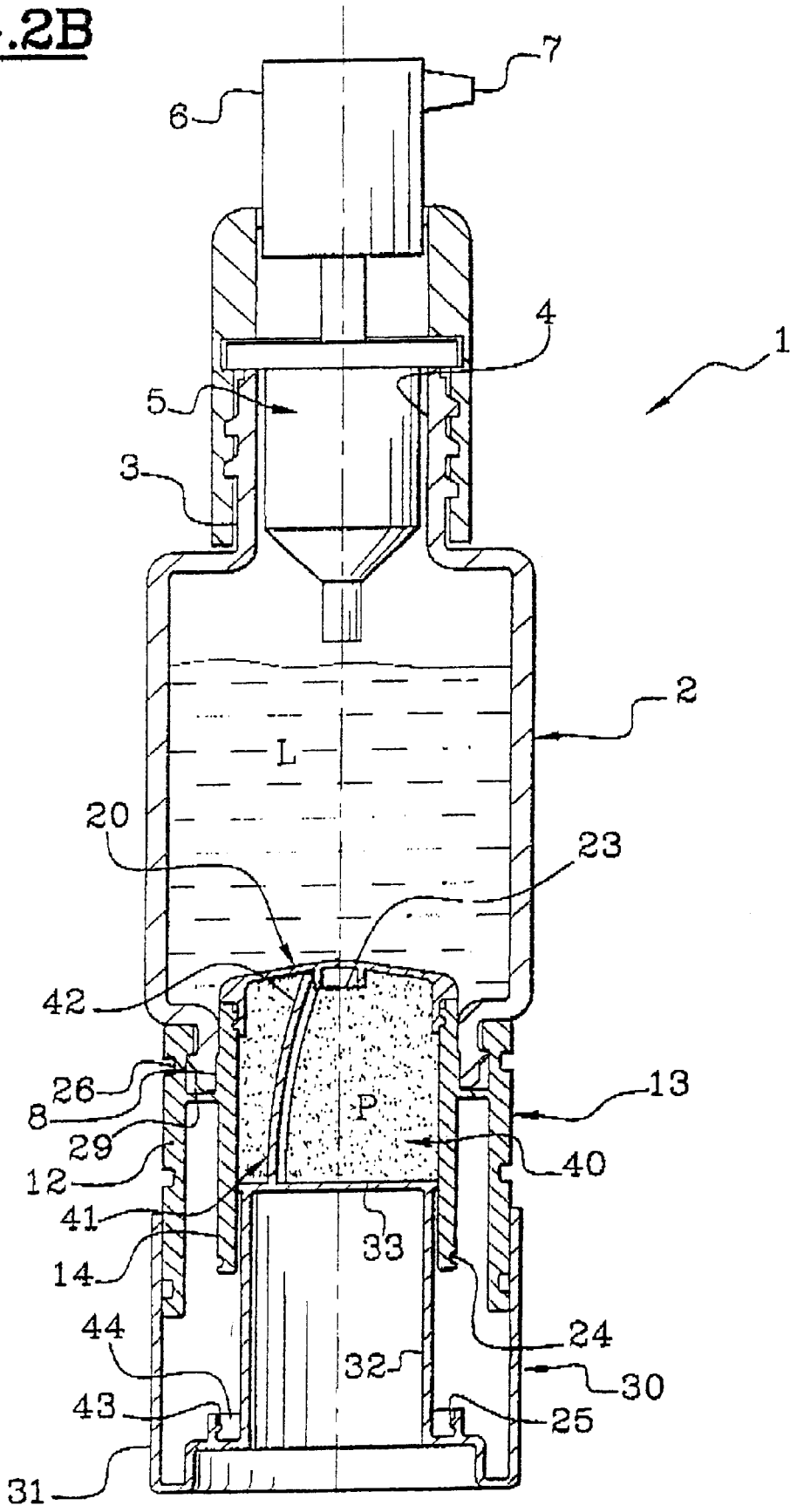
Figure 2C:
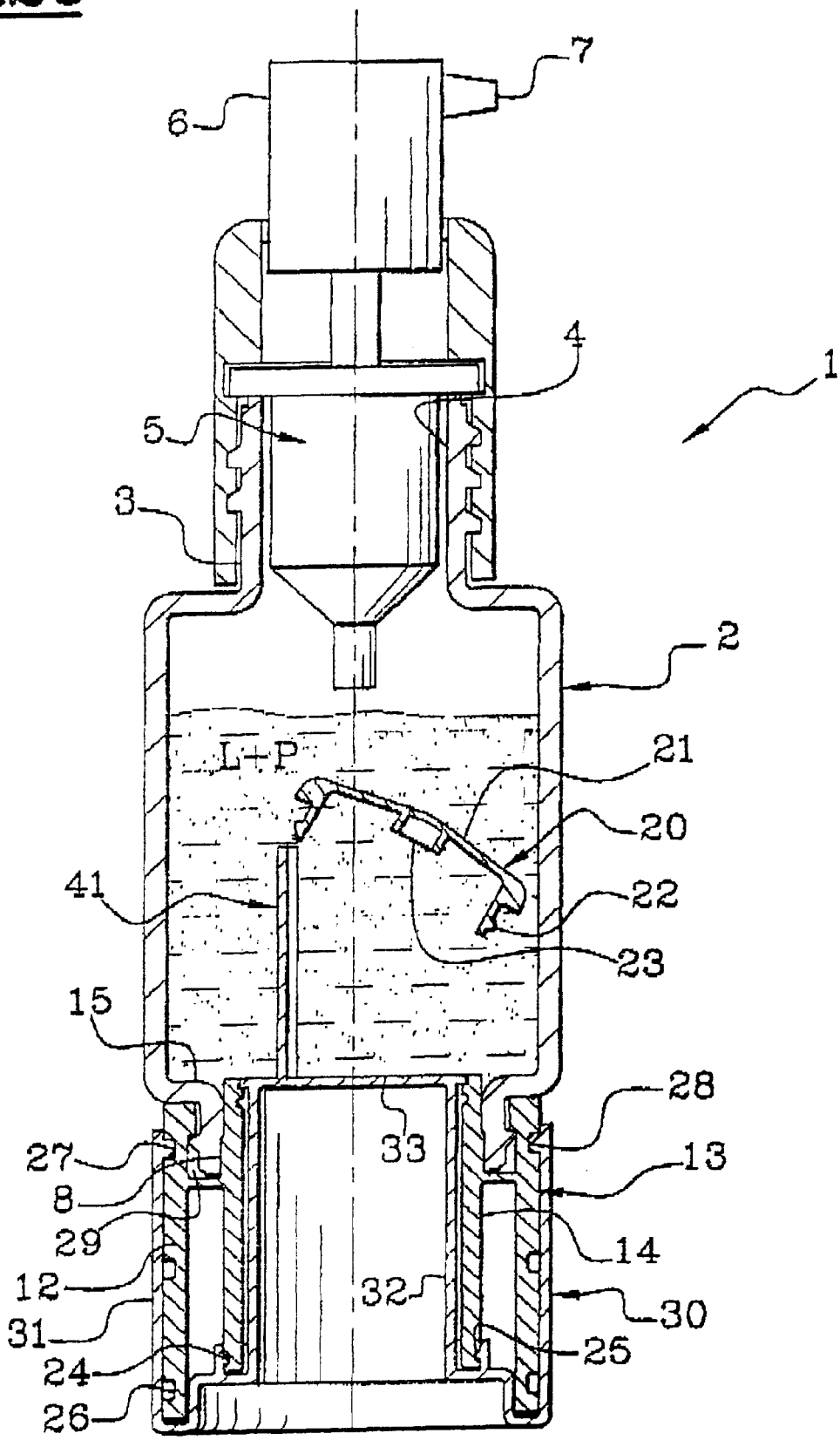

The mixing device 1 depicted in exploded view in FIG. 1, and in the operating views shown in FIGS. 2A–2C, comprises an upper bottle 2, the upper end of which forms a neck 3, a free edge of which delimits an opening 4 into which a pump 5 surmounted by a push-button 6 is screwed. The push-button 6 has a duct communicating with the pump and opening to the outside, via a dispensing orifice 7. The opposite end of the bottle 2 also forms a neck 8, a free edge of which defines an opening 9. The neck 8 has, on its exterior surface, near its free edge, a bulge 10 able to fit, preferably by snap-fastening, on a corresponding bulge 11 provided on the internal surface of the outer skirt 12 of an intermediate element 13.

The intermediate element 13 includes an internal skirt 14, concentric with the outer skirt 12, and of an outside diameter that is such that it can be engaged in sealed fashion inside the neck 8 of the upper container 2. The skirt 14 is open at both ends. The upper end 16 of the skirt 14 engages the neck of the container 2 so that it lies more or less level with a shoulder 15 formed by the container 2. Force-fitted onto the upper end 16 of the skirt is a removable stopper 20 in the shape of a cup, the bottom wall 21 of which is cone-shaped. The vertex of the cone faces towards the container 2.

The stopper 20 has a lateral edge 22 force-fitted inside the skirt 14. A thin bulge 50, intended to fit in a corresponding groove 51 made on the internal surface of the inner skirt 14, may possibly be used to hold the stopper 20 more firmly on the intermediate element 13. Near the vertex of the cone, the bottom wall 21 of the stopper has, on the side opposite to the container 2, an annular rim or stop 23, the function of which will be explained in greater detail later. The radius of the rim 23 is equal to approximately ⅓ of the maximum radius of the stopper 20. The rim 23 is centred on the axis of the device according to the invention.

The skirt 14 is connected to the outer skirt 12 by bridges of material which are spaced uniformly around the entire periphery of the mixing device. With an arrangement of this kind, the skirts 12 and 14 form a U-shaped groove 29 intended to hold the free edge of the neck 8 of the container 2 firmly. Near its lower end, the skirt 14 has, on its outer surface, a groove 24 able, as will be seen later, to take a rib 25 formed by an operating member 30, so as to lock the operating member 30 in a raised position with respect to the intermediate element 13.

The outer skirt 12 of the intermediate element 13 has two helical slots 26, in which coupling elements, preferably studs 27, 28, formed on the internal surface of the operating member 30 are configured to engage.

The operating member 30 has a covering skirt 31, the interior surface of which bears, near its free edge, the two studs 27, 28 which are configured to engage the helical slots 26 of the intermediate element 13. The operating member 30 also includes an inner skirt 32, one end of which is closed by a bottom wall 33. Bottom wall 33 is located slightly above the level of the free edge of the covering skirt 31. The bottom wall 33 is intended to engage, in sealed fashion, inside the internal skirt 14 of the intermediate element 13, so as to form a moving bottom wall for the container 40. Container 40 is thus defined by the skirt 14, the moving bottom wall 33, and the removable stopper 20. Near its periphery, on its surface facing towards the inside of the container 40, the moving bottom wall 33 has a skirt portion 41 forming a flexible finger, the free end 42 of which is located, in the storage position, just beneath the removable stopper 20, in a radial position that is between the catching edge 22 and the annular rim 23. The angular width of the skirt portion 41 is preferably on the order of 60°.

The inner skirt 32, near its lower end and in combination with an annular rim 43, defines a U-shaped groove 44 intended, as will be seen in detail later, to take the lower free end of the skirt 14 of the intermediate element 13. The rib 25 intended to engage with the groove 24 of the intermediate element 13 is formed on the interior surface of the annular rim 43.

The mixing device 1 is depicted in an assembled position in FIG. 2A. The upper container 2 preferably contains a liquid L. This position corresponds to a so-called storage position. The lower container 40 preferably contains a powder P. In this storage position, the bottom wall 33 of the container 40 is located near the lower end of the skirt 14. The flexible finger 41 has its free end 42 located just beneath the stopper 20, the stopper 20 being forced-fitted inside the skirt 14 so as to separate the liquid L from the powder P in sealed fashion. The studs 27 and 28 of the operating member 30 are engaged in the slots 26 of the intermediate element, near their respective lower ends.

To mix the liquid L and the powder P, the user rotates the operating member 30 with respect to the intermediate element 13, which is mounted in a fixed angular position on the container 2. As she does so, the studs 27 and 28 are guided along the corresponding helical slots 26, causing the moving bottom wall 33 to move axially with the flexible finger 41 towards the stopper 20. Almost instantly, the free end 42 of the flexible finger 41 comes into engagement with the interior surface of the stopper 20, and flexes elastically towards the annular rim 23, until the free end 42 abuts against the rim 23. In this position, which is illustrated in FIG. 2B, the flexible finger 41 becomes arched, and exerts enough force to cause the stopper 20 to be moved or released.

As depicted in FIG. 2C, the product L mixes with the powder P. As a preference, the stopper 20 is released after the operating member 30 has been rotated through about ¼ of a turn. Once the stopper 20 has been released, the flexible finger 41 straightens by elastic return. By continued rotation of the operating member 30 with respect to the intermediate element 13, the moving bottom wall 33 of the container 40 continues to move upwards towards the container 2, until the rib 25 of the operating member 30 engages with the groove 24 of the intermediate element 13. In this position, the bottom wall 33 is roughly level with the shoulder 15 of the container. The container 40 is of practically zero volume. Rotating the operating member 30 in the opposite direction with respect to the intermediate element 13 is made impossible because the device is locked through the collaboration of the groove 24 and the rib 25.

The user may shake the mixing device 1, so as to homogenize the mixture. It is also possible that preliminary mixing of the powder and liquid occurs once the stopper has been released by continued rotation of the flexible finger 41.

She then inverts it and operates the pump 5 using the push-button 6. The liquid is then dispensed via the orifice 7.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A mixing device for mixing at least two different products, the device comprising:

a first container for containing a first product;

a second container for containing a second product;

a removable stopper configured to seal said first container from said second container; and an operating member having a flexible finger configured to engage and move said removable stopper from a sealing position upon actuation of the operating member so as to permit mixing of first and second products, wherein the operating member is configured to force the flexible finger against the stopper, and wherein said flexible finger is configured to flex elastically as the operating member forces the flexible finger against the removable stopper.

2. The mixing device of claim 1, wherein said first container contains a first product and said second container contains a second product.

3. The mixing device of claim 2, wherein said first product is a liquid and said second product is a powder.

4. The mixing device of claim 1, wherein the operating member is configured to be actuated by rotary movement having an axial component.

5. The mixing device of claim 4, wherein the rotary movement is a helical movement.

6. A method of mixing a first product and a second product, comprising:

providing the mixing device of claim 1 containing a liquid product in the first container and a powdered product in the second container;

rotating the operating member;

removing the removable stopper from a sealed position between said first and second containers; and mixing the liquid product and the powdered product to produce a final product.

7. The method of claim 6, wherein the final product is a cosmetic product.

8. The method of claim 6, wherein the rotating includes moving at least one coupling element of the operating member in a helical path with respect to an intermediate element.

9. The method of claim 6, wherein the removing includes engaging the removable stopper with the flexible finger.

10. The method of claim 9, wherein the removing further includes moving a wall on which said flexible finger is mounted toward said removable stopper to flex the flexible finger as it engages the removable stopper.

11. A mixing device for mixing at least two different products, the device comprising:

a first container for containing a first product;

a second container for containing a second product;

a removable stopper configured to seal said first container from said second container; and an operating member having a flexible finger configured to engage and move said removable stopper from a sealing position upon actuation of the operating member so as to permit mixing of first and second products, wherein said flexible finger is configured to flex elastically as the flexible finger engages a stop on said removable stopper.

12. A mixing device for mixing at least two different products, the device comprising:

a first container for containing a first product;

a second container for containing a second product;

a removable stopper configured to seal said first container from said second container; and an operating member having a flexible finger configured to engage and move said removable stopper from a sealing position upon actuation of the operating member so as to permit mixing of first and second products, wherein the removable stopper includes a peripheral edge and an annular rim forming a stop, wherein the stop is concentric with the peripheral edge, and wherein the flexible finger is configured to engage the removable stopper between the peripheral edge and the stop.

13. A mixing device for mixing at least two different products, the device comprising:

a first container for containing a first product;

a second container for containing a second product;

a removable stopper configured to seal said first container from said second container; and an operating member having a flexible finger configured to engage and move said removable stopper from a sealing position upon actuation of the operating member so as to permit mixing of first and second products, wherein the removable stopper has an inner surface in fluid communication with the second container and an outer surface in fluid communication with the first container, and wherein at least the inner surface is concave.

14. The mixing device of claim 13, wherein the inner surface is concave and an outer surface of the removable stopper is convex.

15. The mixing device of claim 14, wherein the removable stopper has a conical shape.

16. A mixing device for mixing at least two different products, the device comprising:

a first container for containing a first product;

a second container for containing a second product;

a removable stopper configured to seal said first container from said second container; and an operating member having a flexible finger configured to engage and move said removable stopper from a sealing position upon actuation of the operating member so as to permit mixing of first and second products, wherein the removable stopper has an inner surface in fluid communication with the second container and an outer surface in fluid communication with the first container, wherein at least the inner surface is concave, wherein the removable stopper includes an annular rim in an inner portion of the stopper, and wherein the flexible finger is configured to flex towards the annular rim as it engages the inner concave surface of the removable stopper.

17. A mixing device for mixing at least two different products, the device comprising:

a first container for containing a first product;

a second container for containing a second product;

a removable stopper configured to seal said first container from said second container;

an operating member having a flexible finger configured to engage and move said removable stopper from a sealing position upon actuation of the operating member so as to permit mixing of first and second products, wherein the first container includes first and second openings; and an intermediate element fixedly mounted on the second opening of the first container.

18. The mixing device of claim 17, wherein the intermediate element includes a first skirt having a free edge configured to receive said removable stopper.

19. The mixing device of claim 18, wherein said first skirt forms a part of said second container.

20. The mixing device of claim 19, wherein said operating member includes a wall configured as a moving bottom wall of said second container.

21. The mixing device of claim 20, wherein said flexible finger is mounted on said wall, and wherein a free end of said flexible finger is configured to engage said removable stopper.

22. The mixing device of claim 21, wherein said operating member includes at least one coupling element configured to engage a ramp of said intermediate element.

23. The mixing device of claim 22, wherein said ramp is a helical ramp formed on an outer surface of said intermediate element.

24. The mixing device of claim 23, wherein said operating member is configured such that rotation of the operating member causes axial movement of the wall and flexible finger toward the removable stopper within said first skirt, such that said wall, flexible finger, and any product contained within said second container are moved into said first container.

25. The mixing device of claim 24, wherein the rotation of the operating member which causes axial movement of the wall and flexible finger to move the removable stopper includes less than 360 degrees of rotation of the at least one coupling element about the ramp.

26. The mixing device of claim 25, wherein the rotation ranges from 90 degrees to 180 degrees of rotation of the at least one coupling element about the ramp.

27. The mixing device of claim 23, wherein the ramp is formed on a second skirt concentric with the first skirt, said second skirt having an inside diameter greater than an outside diameter of said first skirt.

28. The mixing device of claim 27, wherein said first and second skirts define an annular groove configured to receive a free edge of a neck of the second opening of the first container to permit fastening of the intermediate element on the first container.

29. The mixing device of claim 17, further comprising a pump with a dispensing orifice mounted in the first opening of the first container.

30. The mixing device of claim 18, wherein the removable stopper is force-fit within the free edge of the first skirt.

31. A mixing device for mixing at least two different products, the device comprising:

a first container for containing a first product;

a second container for containing a second product;

a removable stopper configured to seal said first container from said second container; and an operating member having a flexible finger configured to engage and move said removable stopper from a sealing position upon actuation of the operating member so as to permit mixing of first and second products, wherein said operating member includes a wall configured as a moving bottom wall of said second container, and wherein the flexible finger is a skirt portion intermediate a peripheral edge of the wall and a central portion of the wall.

32. The mixing device of claim 31, wherein said flexible finger has an axial height approximately equal to an axial height of the first skirt.

33. The mixing device of claim 31, wherein the skirt portion forming said flexible finger defines an angular sector ranging from approximately 20 degrees to approximately 90 degrees.

34. The mixing device of claim 33, wherein the skirt portion defines an angular sector ranging from approximately 45 degrees to approximately 70 degrees.

35. A mixing device for mixing at least two different products, the device comprising:

an upper container for containing a first product;

a lower container for containing a second product;

a releasable sealing element between said upper container and said lower container; and a flexible finger within said lower container, said flexible finger configured to engage said sealing element, flex elastically when forced against said sealing element, and release said sealing element from a sealing position between said containers so as to permit mixing of first and second products.

36. The mixing device of claim 35, wherein said upper container contains a first product and said lower container contains a second product.

37. The mixing device of claim 36, wherein said first product is a liquid and said second product is a powder.

38. The mixing device of claim 37, wherein the first and second products are components used to form a cosmetic product.

39. The mixing device of claim 35, wherein said flexible finger is mounted on a movable wall of said lower container.

40. The mixing device of claim 39, wherein said moveable wall is a bottom wall of said lower container.

41. The mixing device of claim 35, further comprising an operating member configured to move said flexible finger in an axially direction.

42. The mixing device of claim 41, wherein said flexible finger is mounted on an upper surface of said operating member, and wherein the upper surface of the operating member is configured to move axially with the flexible finger upon rotation of the operating member.

43. The mixing device of claim 35, wherein the releaseable sealing element includes a peripheral rim and a central annular rim.

44. The mixing device of claim 35, wherein the upper container includes upper and lower openings.

45. The mixing device of claim 44, further comprising a pump with a dispensing orifice mounted in the upper opening of the upper container.

46. The mixing device of claim 45, wherein the releasable sealing element is mounted in the lower opening of the upper container.

47. The mixing device of claim 35, wherein the lower container includes an inner skirt and an outer skirt.

48. The mixing device of claim 47, wherein said inner and outer skirts define an annular groove configured to receive a lower neck portion of said upper container.

49. The mixing device of claim 47, wherein the outer skirt includes at least one helical ramp.

50. The mixing device of claim 49, further comprising an operating member configured to move said flexible finger into engagement with said releaseable sealing element.

51. The mixing device of claim 50, wherein said operating member includes at least one coupling element configured to engage the at least one helical ramp of said outer skirt of said lower container.

52. The mixing device of claim 51, wherein said operating member is configured such that rotation of the operating member causes axial movement of said flexible finger toward the releaseable sealing element.

53. The mixing device of claim 52, wherein said flexible finger is mounted on a moveable wall of the operating member.

54. The mixing device of claim 53, wherein said moveable wall forms a bottom wall of said lower container.

55. The mixing device of claim 53, wherein the rotation of the operating member which causes axial movement of the wall and flexible finger to release the releaseable sealing element includes less than 360 degrees of rotation of the at least one coupling element around the at least one helical ramp.

56. The mixing device of claim 55, wherein the rotation ranges from approximately 90 degrees to approximately 180 degrees of rotation between the at least one coupling element and the at least one helical ramp.

57. A method of mixing a first product and a second product, comprising:

providing the mixing device of claim 35 containing a liquid product in the upper container and a powdered product in the lower container;

axially moving the flexible finger toward the releasable sealing element;

releasing the sealing element from a sealing position between said upper and lower containers; and mixing the liquid product and the powdered product to produce a final product.

58. The method of claim 57, wherein the step of axially moving includes rotating an operating member of the mixing device.

59. The method of claim 58, wherein the rotating includes rotating the operating member at least 90 degrees.

60. The method of claim 58, wherein the rotating includes rotating the operating member less than 360 degrees.

61. The method of claim 58, wherein the axially moving includes moving a wall on which said flexible finger is mounted toward said releaseable sealing element to flex the flexible finger as it engages the releaseable sealing element.

62. The method of claim 57, wherein the releasing includes engaging the releaseable sealing elements with the flexible finger.

63. A mixing device for mixing at least two different products, the device comprising:

an upper container for containing a first product;

a lower container for containing a second product;

a releasable sealing element between said upper container and said lower container; and a flexible finger within said lower container, said flexible finger configured to engage and release said sealing element from a sealing position between said containers so as to permit mixing of first and second products, wherein the releasable sealing element has a conical shape.

64. A mixing device for mixing at least two different products, the device comprising:

an upper container for containing a first product;

a lower container for containing a second product;

a releasable sealing element between said upper container and said lower container; and a flexible finger within said lower container, said flexible finger configured to engage and release said sealing element from a sealing position between said containers so as to permit mixing of first and second products, wherein the releasable sealing element includes a peripheral rim and a central annular rim, and wherein the flexible finger is mounted on a wall of the lower container and is configured to engage the central annular rim of the releasable sealing element.

65. A mixing device for mixing at least two different products, the device comprising:

an upper container for containing a first product;

a lower container for containing a second product;

a releasable sealing element between said upper container and said lower container;

a flexible finger within said lower container, said flexible finger configured to engage and release said sealing element from a sealing position between said containers so as to permit mixing of first and second products; and an operating member configured to move said flexible finger into engagement with said releasable sealing element, wherein said flexible finger is mounted on a movable wall of the operating member, and wherein the flexible finger is a skirt portion intermediate a peripheral edge of the wall and a central portion of the wall.

66. The mixing device of claim 65, wherein said flexible finger has an axial height approximately equal to an axial height of said inner skirt.

67. The mixing device of claim 65, wherein the skirt portion forming said flexible finger defines an angular sector ranging from approximately 20 degrees to approximately 90 degrees.

68. The mixing device of claim 67, wherein the skirt portion defines an angular sector ranging from approximately 45 degrees to approximately 70 degrees.

69. A mixing device for mixing at least two different products, the device comprising:

a first container for containing a first product;

a second container for containing a second product;

a removable stopper configured to seal said first container from said second container; and a movable operating member having a flexible finger configured to engage and move said removable stopper from a sealing position upon actuation of the operating member so as to permit mixing of first and second products, wherein the operating member including the flexible finger is configured such that initial actuation movement of the operating member causes the flexible finger to flex elastically and thereby apply a biasing force to the stopper, and further actuation movement of the operating member causes the elastic flexing of the finger to increase to an extent causing the stopper to be expelled from a position sealing the first container from the second container.

70. A mixing device for mixing at least two different products, the device comprising:

an upper container for containing a first product;

a lower container for containing a second product;

a releasable sealing element between said upper container and said lower container; and a flexible finger within said lower container, said flexible finger being configured to flex elastically and assume a curved shape, thereby exerting sufficient force to expel the releasable sealing element from a sealing position between said containers so as to permit mixing of the first and second products.

71. A mixing device for mixing at least two different products, the device comprising:

a first container for containing a first product;

a second container for containing a second product;

a removable stopper configured to seal said first container from said second container; and an operating member having a flexible finger configured to flex elastically and assume a curved shape, thereby exerting sufficient force to expel the removable stopper from a sealing position upon actuation of the operating member so as to permit mixing of the first and second products.

72. A mixing device for mixing at least two different products, the device comprising:

a first container for containing a first product;

a second container for containing a second product;

a removable stopper configured to seal said first container from said second container; and an operating member having a flexible finger defining an axis, said flexible finger being configured to engage said releasable stopper and flex elastically, thereby deflecting the axis of the flexible finger and exerting enough force to move said removable stopper from a sealing position upon actuation of the operating member so as to permit mixing of first and second products.

* * * * *